United States Patent [19]

Molnar

[11] Patent Number: 4,719,776

[45] Date of Patent: Jan. 19, 1988

[54] COMBINATION LOCK WITH COMBINATION-CHANGING FEATURE

[75] Inventor: Richard Molnar, Elmwood, N.J.

[73] Assignee: Presto Lock, Inc., Garfield, N.J.

[21] Appl. No.: 894,745

[22] Filed: Aug. 11, 1986

Related U.S. Application Data

[63] Continuation of Ser. No. 585,368, Mar. 2, 1984, abandoned.

[51] Int. Cl.[4] ..... E05B 37/02; E05B 37/00; E05B 65/52; A45C 13/10

[52] U.S. Cl. ..... 70/312; 70/70; 70/316

[58] Field of Search ..... 70/70, 74, 312, 315, 70/316, 317

[56] References Cited

U.S. PATENT DOCUMENTS

| | | | |
|---|---|---|---|
| 3,653,343 | 4/1972 | McMartin | 109/64 |
| 3,736,778 | 6/1973 | Bako | 70/70 |
| 3,942,344 | 3/1976 | Gehrie et al. | 70/70 |
| 3,952,561 | 4/1976 | Bako | 70/70 |
| 4,114,408 | 9/1978 | Gee | 70/128 |
| 4,123,923 | 11/1978 | Bako | 70/74 |
| 4,267,716 | 5/1981 | Milles | 70/70 |
| 4,318,287 | 3/1982 | Remington et al. | 70/312 |
| 4,327,566 | 5/1982 | Ling | 70/312 |
| 4,341,101 | 7/1982 | Bako | 70/312 |
| 4,343,163 | 8/1982 | Scelba et al. | 70/312 |
| 4,343,165 | 8/1982 | Bako | 70/316 |
| 4,354,366 | 10/1982 | Bako | 70/312 |
| 4,355,524 | 10/1982 | Bako | 70/312 |
| 4,366,685 | 1/1983 | Remington | 70/70 |
| 4,389,863 | 6/1983 | Bako | 70/312 |
| 4,441,346 | 4/1984 | Castiglioni | 70/312 |
| 4,487,043 | 12/1984 | Milles | 70/312 |
| 4,503,691 | 3/1985 | Li | 70/312 |
| 4,520,641 | 6/1985 | Bako | 70/312 |

FOREIGN PATENT DOCUMENTS

| | | | |
|---|---|---|---|
| 0095529 | 12/1983 | European Pat. Off. | 70/70 |
| 2053341 | 2/1981 | United Kingdom | 70/315 |

*Primary Examiner*—Gary L. Smith
*Assistant Examiner*—Vinh Luong
*Attorney, Agent, or Firm*—Shapiro and Shapiro

[57] ABSTRACT

Front-programmable combination lock in which a shift member moves with a manual actuator button between locked and unlocked positions of the button and also has shifting movement relative to the button to permit the unlocking combination of the lock to be changed. Access to the shift member is provided by openings at opposite sides of the manual actuator button.

7 Claims, 9 Drawing Figures

COMBINATION LOCK WITH COMBINATION-CHANGING FEATURE

This is a continuation application of Ser. No. 585,368 filed Mar. 2, 1984, which is now abandoned.

BACKGROUND OF THE INVENTION

This invention relates to combination or permutation locks and is more particularly concerned with locks in which the user can conveniently change the combination that unlocks the lock.

Combination locks which permit the user to change the combination are well known. See, for example, U.S. Pat. No. 4,123,923 to Bako, issued Nov. 7, 1978 (assigned to the same assignee as the present invention) and the patents referred to therein. The Bako patent discloses a combination lock that is frontprogrammable. In other words, the user can change the combination of the lock from the front of the lock and thus avoid the inconvenience of prior locks in which the combination is changed from the back of the lock only after opening of a luggage case, for example, on which the lock is mounted. To change the combination of the lock of the Bako patent, the user sets the combination dials on-combination (i.e., at the unlocking combination) and moves a manual actuator in a predetermined direction to release a spring-biased hasp. This exposes a plunger that, when depressed, permits the manual actuator to move further in the predetermined direction to a combination-changing position at which the dials can be rotated relative to corresponding locking sleeves to change the combination.

More recently, as disclosed, for example, in U.S. Pat. No. 4,389,863, issued June 28, 1983 and assigned to the same assignee as the present invention, front-programmable combination locks are known in which a separate shift member exposed through a faceplate opening of the lock may be operated after the lock has been set on-combination to permit the combination to be changed.

BRIEF DESCRIPTION OF THE INVENTION

The present invention provides a further improvement in front-programmable combination locks. In one of its broader aspects, a combination lock in accordance with the invention comprises a casing having a combination lock mechanism therein and actuator means including a finger-engageable button mounted exteriorly of said casing and supported for movement in a predetermined direction between a locked position and an unlocked position, said lock mechanism including a plurality of combination dials with peripheral portions thereof exposed through respective slots in a wall of the casing, locking means controlled by said dials for preventing movement of said button from said locked position to said unlocked position until said dials are set at a predetermined unlocking combination, and a shift member supported for movement in said predetermined direction with said button and also for shifting movement relative to said button, said lock mechanism including means responsive to shifting movement of said shift member to permit said dials to select a different unlocking combination, said lock being characterized in that said button has opening means exteriorly of said casing adjacent to said wall of the casing for providing access to a surface of said shift member that may be engaged to cause shifting movement of said shift member.

DESCRIPTION OF THE PREFERRED EMBODIMENT

As will be described hereinafter, the invention employs a combination lock mechanism that is similar to a combination lock mechanism known heretofore. However, the structure which permits the user to change the unlocking combination of the lock and the manner in which the combination is changed constitute a significant improvement over the prior art. In the following description, a preferred embodiment will be described; then the prior art will be described; and finally the difference between the invention and the prior art will be made apparent.

Figure 1:
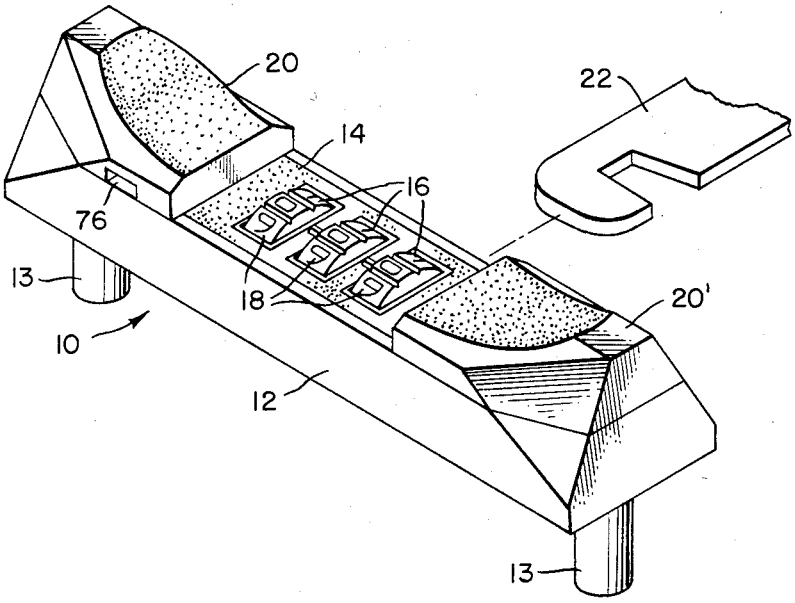
FIG. 1 is a perspective view showing the external appearance of a combination lock in accordance with the invention and showing a cooperable hasp or latch element fragmentarily.
Figure 2:
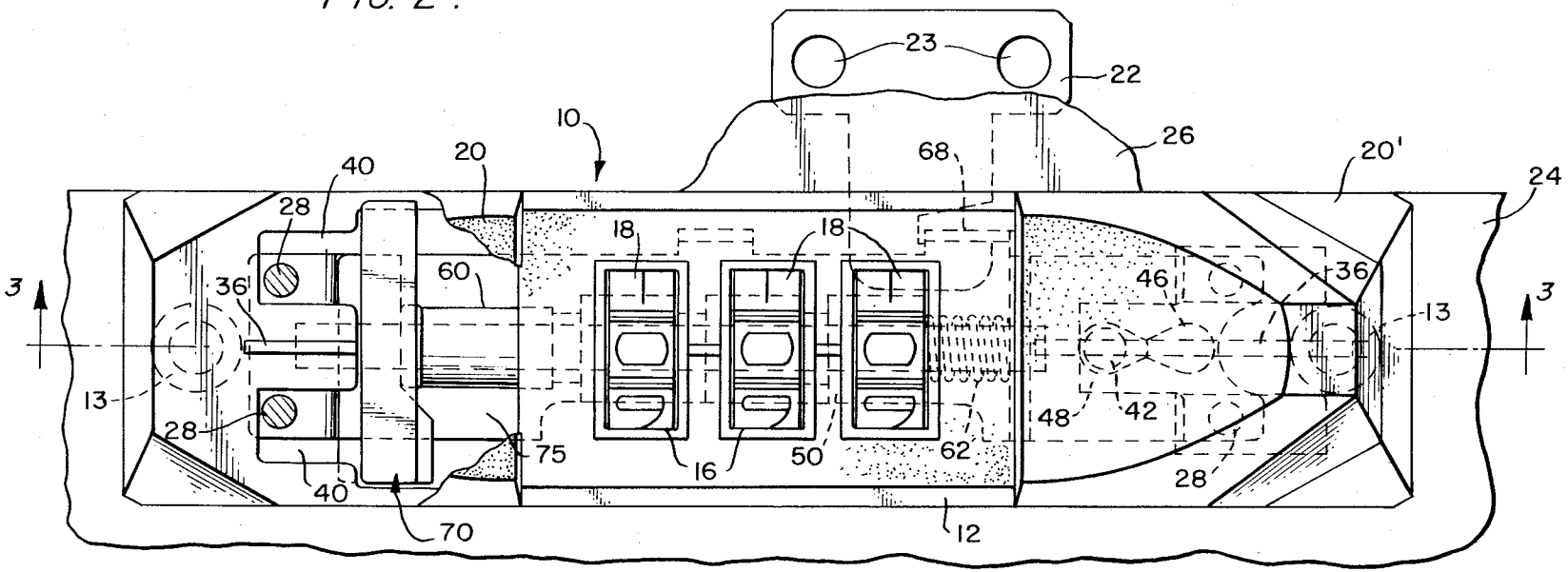
FIG. 2 is a plan view of the lock, partly in section, showing the hasp engaged with the lock.
Figure 5:
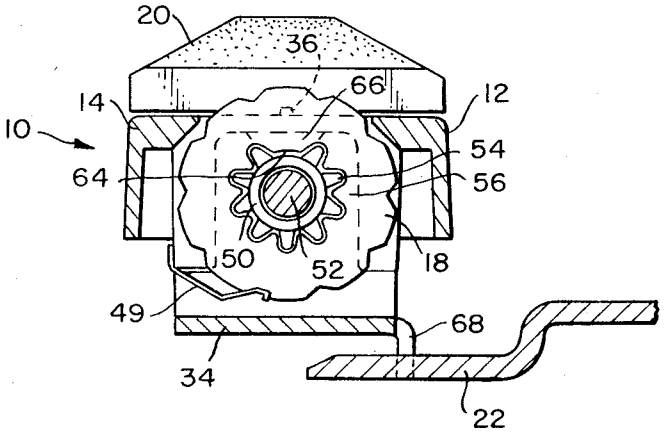
FIG. 5 is a transverse sectional view taken along line 5—5 of FIG. 3.

Referring to the drawings, and initially to FIG. 1, a combination lock 10 in accordance with a preferred embodiment comprises a casing 12 having a faceplate wall 14 with slots 16 through which peripheral portions of indicia-bearing combination dials 18 are exposed. The lock has a manual actuator that, in the preferred form, includes a pair of button 20, 20' at opposite ends of the faceplate. The buttons are shaped for convenient finger engagement, and, as will become apparent hereinafter, are conjointly movable along the length of the faceplate between locked and unlocked positions, the locked position being shown in FIG. 1. A hasp or latch element 22 is engageable with the lock and, as shown in FIGS. 2 and 5, is held in the lock casing when the lock is locked. As shown in FIG. 2, the combination lock may be mounted on the body 24 of a luggage case, for example, and the hasp may be mounted on the lid 26 of the case. For example, the lock and hasp may be attached to valance members at the respective edges of the body and lid by screws or rivets, as is well known, which are received in holes 23 of the hasp 22 and hollow shanks 13 of the casing 12.

Figure 3:
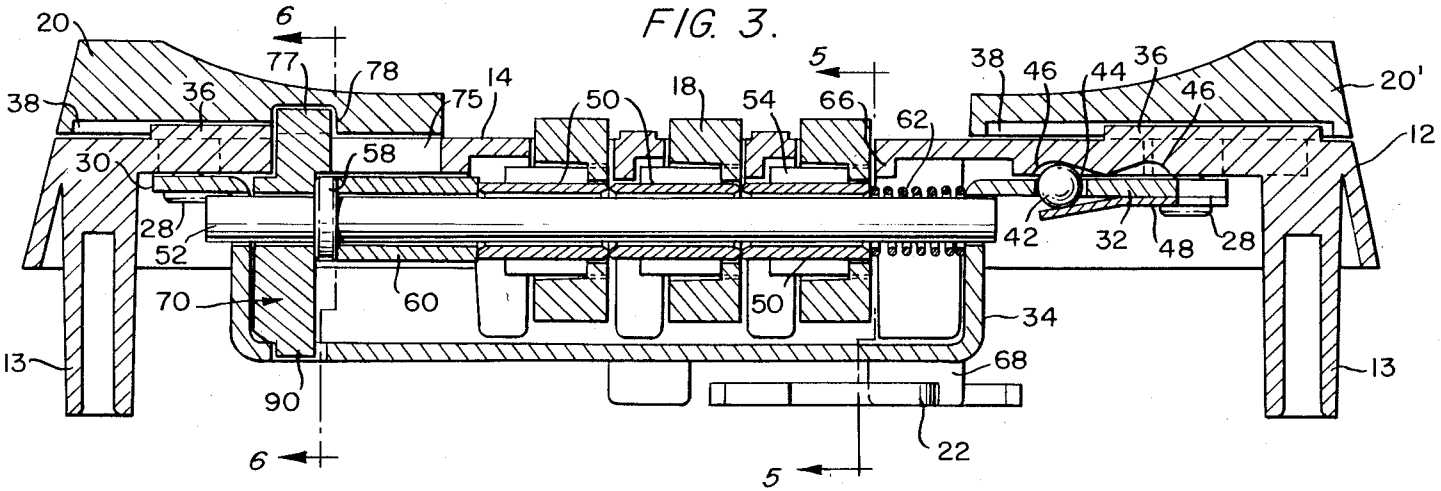
FIG. 3 is a longitudinal sectional view along line 3—3 of FIG. 2 and showing the manual actuator of the lock in its locked position.
Figure 4:
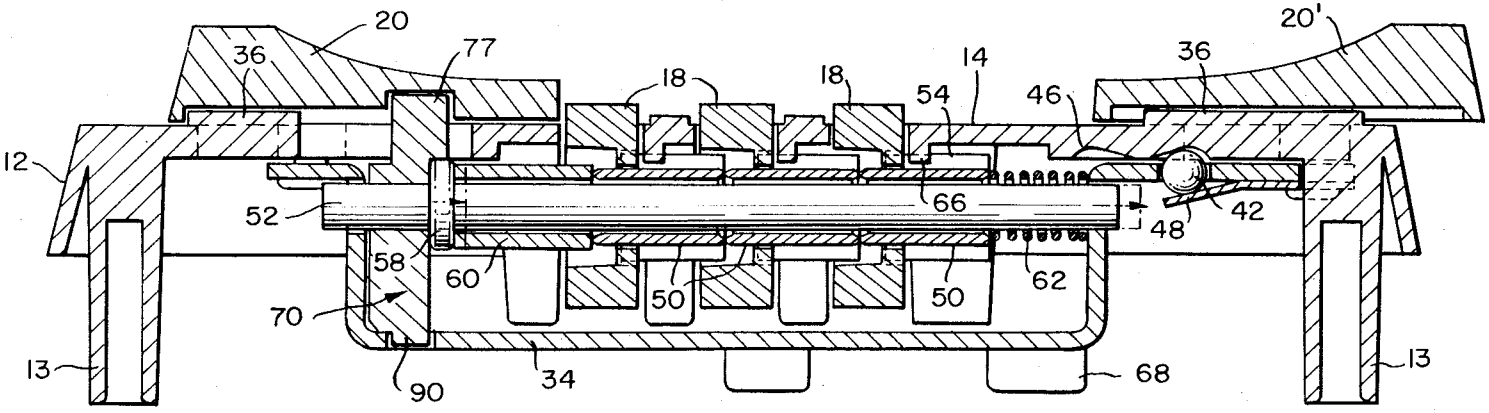
FIG. 4 is a similar longitudinal sectional view showing the manual actuator in its unlocked position and showing, in phantom, the action of a shift member of the lock for permitting the combination to be changed.

As shown in FIGS. 2–4, buttons 20 and 20' are attached, as by rivets 28, to flanges 30 and 32 of a U-shaped frame 34. The frame is disposed within the casing 12 with the flanges 30 and 32 adjacent to the inner surface of the faceplate 14. The outer surface of the faceplate has longitudinal ribs 36 received in recesses 38 on the underside of the buttons 20, 20' to guide the movement of the manual actuator means between its locked and unlocked positions. The ribs may serve as limit stops at those positions. Rivets 28 pass through slots 40 formed in the faceplate. It is apparent that manual actuator buttons 20, 20' and frame 34 move as a unit along the length of the faceplate between locked and unlocked positions (compare FIGS. 3 and 4). A detent device releasably holds the manual actuator in each position and comprises a ball 42 in a hole 44 of flange 32 of the frame and a pair of recesses 46 joined by ramps formed on the inner surface of the faceplate. A leaf spring 48 mounted on flange 32, as by rivets 28, presses ball 42 into engagement with the recesses 46 and the intervening ramps. Thus the manual actuator 20, 20' has a deadbolt action.

In the preferred embodiment, the lock mechanism comprises, in addition to the combination dials 18, a dial spring unit 49 (FIG. 5) that may be mounted on bosses of the faceplate so that spring arms engage indexing notches on the dial peripheries, and a plurality of rotatable locking sleeves 50 supported in end-to-end succession on a shaft 52 that is supported on the frame 34. Each sleeve is releasably coupled to and supports a corresponding dial for rotation about the axis of the shaft. As shown in FIGS. 3–5, each sleeve has a plurality of radial teeth 54 extending a substantial distance along the length of the sleeve and adapted to engage internal teeth 56 of a dial to couple the sleeve to the dial for rotation therewith. Shaft 52 preferably has an integral collar 58 (see FIGS. 3 and 4) separated from the nearest locking sleeve 50 by a spacer sleeve 60. A helical compression spring 62 surrounds the opposite end of the shaft between an end wall of frame 34 and an adjacent locking sleeve 50 and urges all of the sleeves into end-to-end engagement with sleeve 60 and collar 58. As shown in FIG. 5, each locking sleeve 50 has a missing tooth portion 64 adapted to mate with a corresponding blocking formation 66 depending inwardly from faceplate 14 (see FIGS. 3 and 4 also). When sleeves 50 are turned by the associated dials to align all of the missing tooth portions 64 with the corresponding blocking formations, collar 58 may move all of the sleeves along the axis of shaft 52 (rightward in FIG. 3) relative to the dials. However, when any sleeve is positioned so that one of its teeth is aligned with the corresponding blocking formation 66, such axial movement of the sleeves is prevented.

When the dials are turned to display the unlocking combination at the center portions of the slots 16 (the combination 0-0-0 in FIG. 2) the missing tooth portions 64 of the locking sleeves are aligned with the blocking formations 66, so that when rightward finger pressure is applied to button 20' in FIG. 3, buttons 20, 20', frame 34, shaft 52, and sleeves 50 and 60 may move rightward together (along with a shift member to be described) to the unlocked position shown in FIG. 4, being releasably held in that position (as in the locked position) by the detent device comprising the ball 42. A tang 68 formed on the frame 34 moves rightward out of a slot in hasp 22 so that the hasp (which extends into the lock casing through an appropriate opening) is released for withdrawal from the casing.

Generally, the construction of the lock mechanism inside the casing 12, as just described (including the cooperation of the lock mechanism with a hasp and the deadbolt action by means of a pair of manual actuator buttons at opposite sides of the combination dials) is similar to the construction of a combination lock that has been sold commercially by the assignee of the present invention for several years. In the prior lock, a shift lever for changing the combination is suspended from the shaft at one end thereof between the collar on the shaft and an end of the frame and projects radially from the shaft through an opening in the frame. When the manual actuator is moved from its locked position (after the dials are set on-combination) the frame moves also and moves the shift lever, shaft, and sleeves along the axis of the shaft relative to the dials, as described above.

To change the combination of the prior lock, after the manual actuator is placed in its unlocked position and the luggage case bearing the lock is opened, the shift lever, which is exposed inside the luggage case, is pushed along the axis of the shaft by the user, so that the locking sleeves are moved further in the direction in which they move to unlock the lock and sufficiently to disengage the external teeth of the sleeves from the associated internal teeth of the combination dials. The combination dials may then be turned relative to the sleeves (which are held in position by the blocking formations aligned with the missing tooth portions) to change the combination of the lock. After the shift lever has been moved axially to uncouple the sleeves from the dials, it is tilted into a lateral portion of the opening in the frame of the lock, so that the shift lever need not be held manually while the dials are turned to change the combination. After the dials have been turned to the new desired combination, the shift lever is tilted in the opposite sense and released so that the coil compression spring on the shaft will move the sleeves axially and recouple the sleeves to the dials, thereby setting the new combination into the lock.

The present invention is a distinct improvement upon the prior lock in that the user can conveniently change the combination from the front of the lock without opening the luggage case. Moreover, the combination-changing feature of the invention is provided unobtrusively and in a manner that avoids tampering or undesired changing of the combination.

In accordance with the invention, shift member 70 is supported in the lock casing 12 for movement transversely of the shaft 52 (perpendicular to the direction of movement of the manual actuator 20, 20'). In the preferred form, the shift member is block-like and has the configuration shown in FIG. 9. An opening 72 permits the shift member to be received on an end portion of shaft 52 between collar 58 and an adjacent end of frame 34. A portion 74 of reduced thickness protrudes through an opening 75 in faceplate 14 and into a hollow portion of button 20 (see FIG. 6). An opening 76 at one side of button 20 provides access to one end of portion 74 of the shift member. An opposite end 77 of portion 74 is of reduced height and is aligned with an opening 78 opposite to opening 76. Opening 72 in the shift member preferably has the shape shown in FIG. 6 (with a narrow central portion and enlarged end portions) so that the shift member can be moved laterally of the shaft 52 with some resistance and then held stably at either end of its lateral movement.

Figure 7:
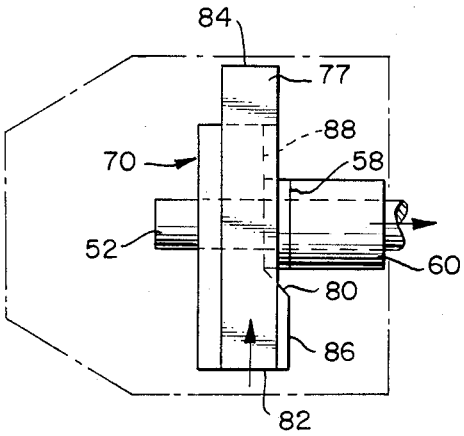
FIGS. 7 and 8 are somewhat diagrammatic plan views showing the action of the shift member.
Figure 8:
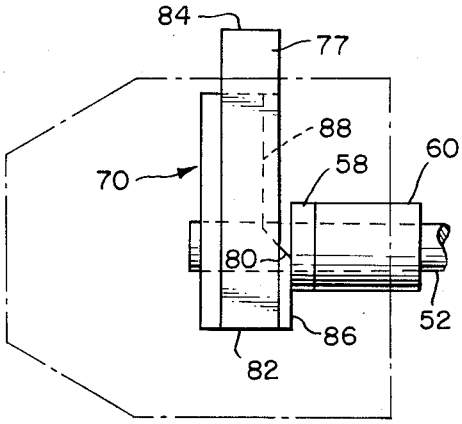
Figure 9:
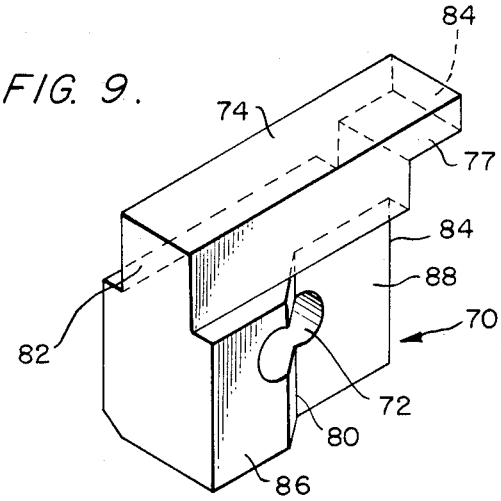
FIG. 9 is a perspective view of the shift member.
Figure 6:
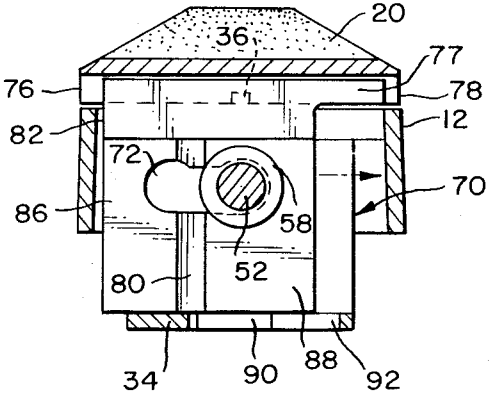
FIG. 6 is a transverse sectional view taken along line 6—6 of FIG. 3.

As shown in FIGS. 7–9, the shift member has a cam surface 80 in the form of a ramp that engages the collar 58 of the shaft to move the shaft axially when the shift member is moved laterally of the shaft (in the direction of the arrow in FIG. 7). For this purpose, an implement, such as the tip of a ballpoint pen, may be inserted in opening 76 of button 20 to press against a surface 82 of the shift member. When the shift member has moved to the position of FIG. 8, portion 77 preferably projects through opening 78 (FIG. 6) so that pressure may be exerted on surface 84 manually to return the shift member to the position of FIG. 7. In FIG. 8, collar 58 is urged by compression spring 62 (FIG. 4) into engagement with a surface 86 of the shift member that is perpendicular to the axis of shaft 52, so that the shift member maintains its position securely. When the shift member is in the position of FIG. 7, collar 58 is engaged with a surface 88 of the shift member that is, again, perpendicular to the axis of shaft 52. As shown in FIGS. 3, 4, and 6, the shift member may have a projection 90 that fits within a slot 92 of frame 34 to assist in guiding the lateral movement of the shift member.

From the foregoing description, it is apparent that the shift member moves along the axis of shaft 52 along with manual actuator 20, 20' between its locked and unlocked positions. After the manual actuator has been moved to its unlocked position, the shift member can be moved laterally to move the shaft 52 to the phantom line position shown in FIG. 4 in order to uncouple the locking sleeves 50 from the combination dials 18 (the axial length of the sleeve teeth 54 being selected to provide such uncoupling). Movement of the sleeves in this regard is accompanied by compression of spring 62. If the shift member is moved laterally before the manual actuator is moved to its unlocked position, sleeves 50 will not be uncoupled from the dials, because the sleeves will not have already moved axially relative to the dials, as occurs when the manual actuator is moved to its unlocked position, and the incremental movement of the sleeves relative to the dials due to lateral movement of the shift member will not be sufficient to uncouple the sleeves from the dials.

It is apparent that the invention permits the user to change the combination conveniently from the front of the lock, and yet the combination-changing feature is unobtrusive and is constructed so that inadvertent or unauthorized changing of the combination is very unlikely. Furthermore, the advantages of the invention are provided simply and effectively in conjunction with a combination lock mechanism of proven commercial merit and without requiring expensive modification of the basic lock mechanism.

While a preferred embodiment of the invention has been shown and described, it will be apparent to those skilled in the art that changes can be made in this embodiment without departing from the principles and spirit of the invention, the scope of which is defined in the appended claims.

What is claimed is:

1. In a combination lock comprising a casing having a combination lock mechanism therein for controlling the locking and unlocking of a member cooperable with but separate from said lock, and actuator means including finger-engageable button means mounted exteriorly of said casing and supported for movement in a predetermined direction between a locked position at which said member is locked and an unlocked position at which said member is unlocked, said lock mechanism including a plurality of combination dials with peripheral portions thereof exposed through respective slots in a faceplate wall of the casing, said button means being supported for movement along said faceplate wall at an end thereof beyond said peripheral portions of said dials, locking means controlled by said dials for preventing movement of said button means from said locked position to said unlocked position until said dials are set at a predetermined unlocking combination, and a shift member supported for movement with said button means to said unlocked position and also for shifting movement relative to said button means while said button means is at said unlocked position, said lock mechanism including means responsive to shifting movement of said shift member to permit said dials to select a different unlocking combination, the improvement in that said shifting movement of said shift member is transverse to said predetermined direction of movement of said button means and in that said button means has opening means accessible from the exterior of said casing adjacent to said wall of the casing for providing access to a surface of said shift member to cause shifting movement of said shift member, and wherein said opening means comprises a pair of spaced, separate openings accessible only at opposite sides of the exterior of said button means, respectively, through respective exterior surfaces of said lock that are substantially perpendicular to said faceplate wall and said shift member is supported for said shifting movement between a first position at which a portion of said shift member is disposed to be engaged through one of said openings and a second position at which another portion of said shift member protrudes through the other of said openings.

2. A combination lock in accordance with claim 1, wherein said lock mechanism includes a shaft and said locking menas includes sleeves rotatably supported on said shaft in end-to-end succession, each sleeve supporting one of said combination dials for rotation on said shaft and being releasably coupled to that dial for rotation therewith, each sleeve having tooth means requiring that the sleeve have a predetermined rotational position before said button means can be moved to its unlocked position and wherein said means responsive to shifting movement of said shift member comprises cam means for moving the sleeves along the axis of the shaft relative to the dials and uncoupling the sleeves from the dials so that the dials may be rotated relative to the sleeves.

3. A combination lock in accordance with claim 2, wherein said lock mechanism includes means for causing said sleeves to move in said predetermined direction along the axis of said shaft relative to said dials, without being uncoupled therefrom, when said button means moves from its locked position to its unlocked position, and wherein the construction of said sleeves is such that the sleeves are uncoupled from the dials only upon further movement in said predetermined direction in response to said shifting movement of said shift member.

4. A combination lock in accordance with claim 3, wherein said lock mechanism includes a frame fixed to said button means for movement therewith and supporting said shaft, said sleeves, and said shift member for movement together in said predetermined direction when said button means moves to its unlocked position, and wherein said tooth means of said sleeves cooperates with blocking means for blocking movement of said sleeves in said predetermined direction until the sleeves have said predetermined rotational position.

5. A combination lock in accordance with claim 4, wherein said lock mechanism includes spring means for biasing said sleeves in a direction opposite to said predetermined direction and wherein said shift member has means for releasably holding the same at its second position.

6. A combination lock in accordance with claim 5, further comprising means for releasably holding said button means at its locked and unlocked positions, respectively.

7. In a combination lock comprising a casing having a combination lock mechanism therein for controlling the locking and unlocking of a member cooperable with but separate from said lock, and actuator means including finger-engageable button means mounted exteriorly of said casing and supported for movement in a predetermined direction between a locked position at which said member is locked and an unlocked position at which said member is unlocked, said lock mechanism including a plurality of combination dials with peripheral portions thereof exposed through respective slots in a faceplate wall of the casing, locking means controlled by said dials for preventing movement of said button means from said locked position to said unlocked position until said dials are set at a predetermined unlocking combination, and a shift member supported for movement with said button means to said unlocked position and also for shifting movement relative to said button means while said button means is at said unlocked position, said lock mechanism including means responsive to said shifting movement of said shift member to permit said dials to select a different unlocking combination, the improvement in that said shifting movement of said shift member is transverse to said predetermined direction of movement of said button means, in that said shift member has camming means for moving a portion of said locking means relative to said dials in response to said transverse shifting movement of said shift member, so that said dials may select said different unlocking combination, and in that said lock has opening means adjacent to said faceplate wall through an exterior surface of said lock that is substantially perpendicular to said faceplate wall for providing access to a surface of said shift member against which a force can be exerted to cause said transverse shifting movement of said shift member wherein said opening means comprises a pair of spaced, separate openings accessible only at opposite sides of the exterior of said lock, respectively, through exterior surfaces of the lock that are substantially perpendicular to said faceplate wall, and wherein said shift member is supported for reciprocative shifting movement along a path between said openings.

* * * * *